US006344111B1

(12) United States Patent
Wilhelm

(10) Patent No.: US 6,344,111 B1
(45) Date of Patent: Feb. 5, 2002

(54) PAPER TISSUE HAVING ENHANCED SOFTNESS

(75) Inventor: Lee Delson Wilhelm, Appleton, WI (US)

(73) Assignee: Kimberly-Clark Wordwide, Inc., Neenah, WI (US)

( * ) Notice: Subject to any disclaimer, the term of this patent is extended or adjusted under 35 U.S.C. 154(b) by 0 days.

(21) Appl. No.: 09/283,502

(22) Filed: Apr. 1, 1999

Related U.S. Application Data

(60) Provisional application No. 60/086,090, filed on May 20, 1998.

(51) Int. Cl.[7] ..... D21F 11/00

(52) U.S. Cl. ..... 162/117; 162/118; 162/113; 162/101; 162/109; 428/156; 428/153; 428/174; 428/175; 428/176; 428/179; 493/395

(58) Field of Search ..... 162/117, 118, 162/113, 111, 109; 428/156, 153, 174–179; 493/395

(56) References Cited

U.S. PATENT DOCUMENTS

| | | | | |
|---|---|---|---|---|
| 496,964 A | | 5/1893 | Wheeler | 162/109 |
| 3,673,060 A | | 6/1972 | Murphy et al. | 161/126 |
| 3,708,366 A | | 1/1973 | Donnelly | 156/209 |
| D241,272 S | | 8/1976 | Matsumoto | D5/6 |
| 4,307,141 A | | 12/1981 | Walbrun | 428/132 |
| 4,320,162 A | | 3/1982 | Schulz | 428/154 |
| 4,326,002 A | | 4/1982 | Schulz | 428/178 |
| 4,376,671 A | | 3/1983 | Schulz | 156/549 |
| D288,150 S | | 2/1987 | Schulz | D5/53 |
| 4,659,608 A | | 4/1987 | Schulz | 428/171 |
| 4,759,967 A | | 7/1988 | Bauernfeind | 428/154 |
| 4,803,032 A | | 2/1989 | Schulz | 264/284 |
| 4,921,034 A | * | 5/1990 | Burgess | 162/109 |
| 4,942,077 A | | 7/1990 | Wendt et al. | 428/152 |
| 4,978,565 A | | 12/1990 | Pigneul et al. | 428/156 |
| D322,173 S | | 12/1991 | Schulz | D5/53 |
| 5,300,347 A | | 4/1994 | Underhill et al. | 428/171 |
| 5,328,565 A | | 7/1994 | Rasch et al. | 162/113 |
| 5,356,364 A | | 10/1994 | Veith et al. | 493/395 |
| 5,436,057 A | | 7/1995 | Schulz | 428/156 |
| 5,503,896 A | | 4/1996 | Veith et al. | 428/141 |
| 5,529,563 A | | 6/1996 | Veith et al. | 493/395 |
| 5,597,639 A | | 1/1997 | Schulz | 428/156 |
| 5,620,776 A | | 4/1997 | Schulz | 428/156 |

FOREIGN PATENT DOCUMENTS

| | | |
|---|---|---|
| CA | 1299079 | 4/1992 |
| CA | 2191838 | 10/1996 |
| EP | 0560257 | 9/1993 |
| GB | 2132141 | 7/1984 |
| WO | 9618771 | 6/1996 |

* cited by examiner

*Primary Examiner*—Stanley S. Silverman
*Assistant Examiner*—M. Halpern
(74) *Attorney, Agent, or Firm*—Thomas J. Connelly; Patricia A. Charlier; Douglas G. Glantz

(57) ABSTRACT

A novel paper article, a method of making a paper product, and an embossing roll are disclosed for providing a paper surface region having a minority of fiber to fiber bonds broken in the paper surface region to a depth less than about 0.02 mm from the paper surface. In one aspect, the roughened embossing roll includes protuberances or depressions sized at less than about 0.1 mm. In one aspect, the roughened embossing roll includes protuberances or depressions adapted to produce paper product surface deformations in the paper surface, wherein the paper product surface deformations are invisible to an unaided human eye. The present invention provides a paper product having higher perceived softness while maintaining tensile strength.

14 Claims, 11 Drawing Sheets

PAPER TISSUE HAVING ENHANCED SOFTNESS

This application claims benefit of provisional application No. 60/086,090 filed May. 20, 1998.

BACKGROUND OF THE INVENTION

1. Technical Field

The present invention relates to paper products. In one aspect, the invention relates to an embossed paper product having enhanced softness.

2. Background

A wide variety of product characteristics must be given attention in order to provide a paper tissue product having the appropriate blend of attributes suitable for the product's intended purposes. Contributing to the wide variety of product characteristics is a vast array of different paper tissue product forms, such as facial tissue, bath tissue, napkins, and towels. Irrespective of product form, however, improved softness of the paper tissue product has long been one major objective, especially for premium products.

INTRODUCTION TO THE INVENTION

Major components of softness include stiffness and bulk. Lower stiffness and higher bulk improve perceived softness.

Embossing increases sheet caliper or bulk. The higher bulk can improve perceived softness. Embossing also provides an additional benefit by imparting a decorative pattern to the tissue product. A disadvantage associated with embossing is a reduction of the tensile strength of the product.

Besides embossing, the perceived softness of a product can be improved by (1) adding chemicals, (2) calendering, (3) changing furnish, and (4) changing creping. Like embossing, these methods also generate a concurrent decrease in the tensile strength of the product when they are used to increase softness.

Thus, despite improvements in bulk and aesthetic appearance gained from embossing, additional improvements in softness would be beneficial to consumers. Processes and equipment are lacking and needed in the art for further improving the softness of embossed paper products without an accompanying reduction in tensile strength.

SUMMARY OF THE INVENTION

The present invention provides a method of making a paper product having a paper surface and a paper surface region treated by contact with a roughened embossing roll to form a minority of fiber to fiber bonds broken in the paper surface region to a depth less than about 0.02 mm from the paper surface, the paper product having a majority of bonds maintained substantially not broken in an interior region at a depth from the paper surface of more than about 0.02 mm. In one aspect, the roughened embossing roll includes protuberances or depressions sized at less than about 0.1 mm. In one aspect, the roughened embossing roll includes protuberances or depressions adapted to produce paper product surface deformations in the paper surface, wherein the paper product surface deformations are invisible to an unaided human eye.

The present invention provides a novel embossing roll having a roughened surface in the form of protuberances or depressions sized to break a minority of fiber to fiber bonds in a paper surface region of a paper product, wherein the protuberances or depressions are sized at less than about 0.1 mm. The roughened embossing roll surface includes protuberances or depressions adapted to produce paper product surface deformations in the paper product, wherein the paper product surface deformations are invisible to the unaided human eye.

The present invention provides a paper product having higher perceived softness while maintaining tensile strength.

DETAILED DESCRIPTION

Figure 1:
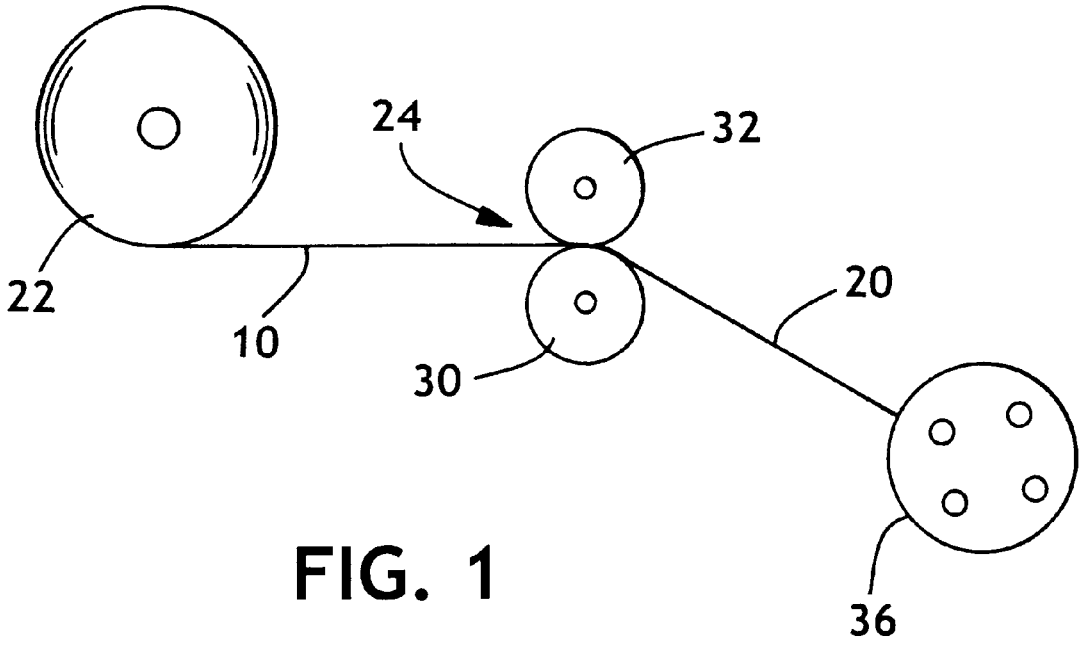
FIG. 1 is a schematic illustration of a process for texturizing paper products according to the present invention.

The present invention provides a method of making a paper product having a paper surface and a paper surface region treated by contact with a roughened embossing roll to form a minority of fiber to fiber bonds broken in the paper surface region to a depth less than about 0.02 mm from the paper surface, the paper product having a majority of bonds maintained substantially not broken in an interior region at a depth from the paper surface of more than about 0.02 mm.

By fiber to fiber bonds is meant the bonds in a paper product formed by hydrogen bonds, e.g., in a paper tissue web, or chemical bonds attributable to strengthening agents added to the web. By a minority of fiber to fiber bonds is meant about 5% to 20%, preferably about 10%, of the total bonds in a paper product region. It has been found that at levels of less than about 5% of the bonds broken in the paper surface region to a depth less than about 0.02 mm from the paper surface does not provide the preferred softening. At levels over about 20% of the bonds broken in the paper surface region to a depth less than about 0.02 mm from the paper surface, strengthening begins to be negatively affected.

By a majority of fiber to fiber bonds is meant over about 50%, preferably over about 90%, more preferably over about 95%, of the total bonds in a paper product region.

In one aspect, the roughened embossing roll includes protuberances or depressions sized at less than about 0.1 mm. In one aspect, the roughened embossing roll includes protuberances or depressions adapted to produce paper product surface deformations in the paper surface, wherein the paper product surface deformations are invisible to an unaided human eye. In one aspect, the paper product further includes decorative embossing. In one aspect, the roughened embossing roll includes pits having a depth less than about 0.1 mm. The step of providing a paper product having a paper surface and a paper surface region treated by contact with a roughened embossing roll to form a minority of fiber to fiber bonds broken in the paper surface region to a depth less than about 0.02 mm from the paper surface forms a paper product having higher perceived softness. In one aspect, the roughened embossing roll includes channels having a depth of less than about 0.1 mm.

The present invention provides a novel embossing roll having a roughened surface in the form of protuberances or depressions sized to break a minority of fiber to fiber bonds in a paper surface region of a paper product, wherein the protuberances or depressions are sized at less than about 0.1 mm. The roughened embossing roll surface includes protuberances or depressions adapted to produce paper product surface deformations in the paper product, wherein the paper product surface deformations are invisible to the unaided human eye. In one aspect, the roughened embossing roll surface includes protuberances or depressions formed by etching or laser engraving the embossing roll. In one aspect, the roughened embossing roll surface includes protuberances or depressions formed by stippling. In one aspect, the embossing roll contains visible embossing areas for forming visible paper embossments separated by land areas containing the protuberances or depressions for forming invisible surface deformations in the paper product.

The present invention provides a paper product including a paper tissue web having a paper surface and a paper surface region treated by contact with a roughened embossing roll to form a minority of fiber to fiber bonds broken in the paper surface region to a depth less than about 0.02 mm, the paper tissue web having fiber to fiber bonds maintained substantially not broken in an interior region at a depth from the paper surface of more than about 0.02 mm. In one aspect, the paper tissue web has a paper surface and a paper surface region treated by contact with a roughened embossing roll which includes protuberances or depressions sized at less than about 0.1 mm. In one aspect, the paper tissue web has paper product surface deformations are invisible to the unaided human eye formed by the roughened embossing roll protuberances or depressions. In one aspect, the paper tissue web has decorative embossing. In one aspect, the paper tissue web has a paper surface and a paper surface region treated by contact with a roughened embossing roll which includes etched protuberances or depressions having a height or depth less than about 0.1 mm. The paper surface region treated by contact with the roughened embossing roll exhibits higher perceived softness while maintaining substantially similar levels of tensile strength.

In accordance with the methods and apparatus of the present invention, an embossing roll is formed with land areas having a roughened surface and separate the male embossing elements. The roughened surface includes either protuberances or pits of about 0.1 millimeter that work the surface fibers of a cellulosic web as it is passed through an embossing nip formed between the embossing roll and a backing roll. The resulting "texturizing" of the web is found to enhance softness. The embossing roll also includes a plurality of ridges or channels or both that similarly work the surface fibers.

In accordance with the methods and apparatus of the present invention, a paper tissue web is passed through an embossing nip including an embossing roll having a roughened surface disposed between the embossing elements. Specifically, in one embodiment, an embossing roll is formed with male embossing elements separated by land areas, and the land areas have a roughened surface. The roughened surface includes either raised areas referred to herein as protuberances or includes depressions referred to herein as pits. When a paper product such as bath tissue is passed through an embossing nip formed between the roughened embossing roll of the present invention and a backing roll, the perceived softness has been found to be improved.

In accordance with the methods and apparatus of the present invention, a perceived softness is beneficiated for paper products processed by the methods and apparatus of the present invention.

The softness of a tissue product as perceived by a consumer is thought to be affected by four factors, which can be measured by trained sensory experts (Sensory Panel Participants or SPP). One attribute of a surface of a tissue that is indicative of the softness of the tissue is referred to herein as a Fuzzy attribute of the tissue surface. On the other hand, attributes of a tissue surface that are counter-indicative of the softness of the tissue are referred to herein as Gritty and Grainy attributes of the tissue surface. Thickness is a fourth attribute reflective of perceived softness, with higher values perceived as being softer. The methods disclosed herein have been found to increase the Fuzzy attribute of the embossed side of a tissue product without degrading the tensile strength of the tissue. The increase in the Fuzzy attribute is a result of the paper product being "texturized" in the land areas between the embossing elements. More specifically, the paper product is "texturized" in the sense that the surface fibers appear to be worked, flexed, or displaced, or a combination of worked, flexed or displaced, by the roughened areas of the embossing roll.

In accordance with the methods and apparatus of the present invention, working only the surface fibers breaks the bonds at the surface, improving feel, but maintains the lower bonds intact, maintaining strength. Loosely bound surface fibers feel softer because they are able to flex more freely when touched. The "texturizing" of the tissue between the embossments produces a tissue product with enhanced softness.

Geometric mean tensile strength (GMT) is the square root of the product of the machine direction tensile strength and the cross-machine direction tensile strength of the web. Unless otherwise indicated, the term "tensile strength" means "geometric mean tensile strength." Tensile strengths are measured using an Instron tensile tester using a 3 inches jaw width, a jaw span of 4 inches, and a crosshead speed of 10 inches per minute after maintaining the sample under TAPPI conditions for 4 hours before testing.

A wide range of shapes and sizes of surface roughness features are effective in working the sheet to produce additional softness.

In accordance with the method and apparatus of the present invention, it has been found that one important factor is the invisible nature of the resulting fiber displacement, which provides a cleaner, less busy finished product appearance. The impact of the roughened land areas is undetectable by the unaided human eye in the processed tissue.

In accordance with the method and apparatus of the present invention, it has been found that a second important factor is that only the surface layers of fibers in the sheet are worked so as to achieve a surface softness increase (Fuzzy) while maintaining the geometric mean tensile (GMT) strength (flexibility) of the sheet as high as possible.

In one embodiment of the present invention, the embossing roll includes land areas having a pitted surface. The pitted surface includes features such as holes, cavities, scars, hollows, hooks, dimples, depressions, or the like. The pitted surface features have a diameter of about 0.01 to about 0.5 mm., preferably about 0.08 to about 0.25 mm., for example, about 0.1 mm. The pitted surfaces are created by etching the surface with a corrosive material such as acid, or they are created by mechanical treatments such as machining, stippling, or engraving.

In another embodiment of the present invention, the embossing roll includes land areas having a plurality of protuberances. The protuberances include features such as bumps, ridges, mounds, hills, humps, waves, crests, crowns, or the like. The protuberances of the present invention have a height dimension compared to the surrounding surface of the land areas of about 0.01 to about 0.5 mm., preferably about 0.08 to about 0.25 mm., for example about 0.1 mm. The protuberances are created by etching the surface of the reverse impression tool used to form the embossing roll by etching the surface with a corrosive material such as acid, or they are created by mechanical treatments such as machining, stippling, or engraving.

In addition to the roughened surface or as an alternative thereto, the land areas of the present invention include a plurality of ridges or channels or both. These ridges and channels also are relatively small and function to work the surface fibers of the paper to improve perceived softness. The ridges have a height dimension and the channels have a depth dimension of surface features of about 0.01 to about 0.5 mm., preferably about 0.08 to about 0.25 mm., for example, about 0.1 mm., more preferably about 0.1 millimeter (0.004 inch) or less, preferably about 0.08 millimeter (0.003 inch) or less, such as about 0.05 millimeter (0.002 inch) or less. The ridges and channels have a width dimension of about 0.08 millimeter (0.003 inch) or less, preferably about 0.05 millimeter (0.002 inch) or less, such as about 0.025 millimeter (0.001 inch). The plurality of ridges and/or channels are suitably spaced apart from one another by about 0.08 to about 0.18 millimeter (0.003–0.007 inch).

The male embossing elements of the embossing roll project upward from the surrounding land areas. The male embossing elements have a height dimension of about 0.005 inch (0.13 mm) or greater, such as from about 0.005 to about 0.07 inch (0.13–1.78 mm), and preferably from about 0.028 to about 0.04 inch (0.71–1.02 mm).

In particular embodiments, it is preferred that the male embossing elements have a relatively low element height to facilitate the tissue sheet contacting the land areas intermediate the male embossing elements. For example, the male embossing elements preferably have a height dimension of about 0.005 inch (0.13 mm) to about 0.035 inch (0.9 mm).

The benefits obtained from the roughened surface of the land areas are independent of the visible embossing pattern created by the male embossing elements. Only visible embossing patterns that are so compact as to prevent contact between the sheet surface and the land areas of the embossing roll would be anticipated not to exhibit similar softness improvements. Moreover, the degree of improvement correlates to the size of the open areas in the visible embossing pattern, and inversely correlates to the hardness of the rubber roll used in the embossing nip.

A steel embossing roll normally would be used for production situations, rather than the laser-engraved ebonite roll used in the Examples described below. To increase the surface softness of a tissue product while maintaining its tensile strength, a number of surface roughening methods could be used while engraving either the master tooling or the final embossing roll. For maximum efficiency, these methods are best applied to the master tooling so that mirror copies will result in the finished roll.

Suitable methods include the following or any combination thereof: (1) Stippling—individual dots are hammered into the steel surface with small tools; (2) Machining—a micro pattern is cut or drilled into the roll surface; (3) Free etching—uncontrolled acid etching is used to remove softer areas of the steel at random; (4) Match engraving—a laser engraved ebonite roll is used as a master engraving tool to duplicate the random surface produced by the laser; and (5) Random engraving—A steel roll is engraved by a laser or plasma arc process.

In a preferred process of the present invention, the desired visible (decorative) pattern is engraved into an intermediate tool to a depth greater than the desired depth of the finished embossing roll. A second tooling blank is prepared by methods 1, 4, or 5 described above to produce the rough surface finish described herein, for example, as seen in the photomicrographs of the laser engraved roll described herein below. Finally, a first intermediate tool is used to match engrave the decorative pattern into the roughened second tooling blank to the desired depth of the finished embossing roll, thereby not erasing the roughened surface of the second tool. From the first intermediate tool, a finished embossing roll then is engraved for commercial use.

The bath tissue rolls made according to the Examples described herein below were submitted for sensory panel evaluation. The sensory panel utilized individuals trained to compare tissue products and evaluate tactile properties versus standard products. The panelists were asked to render numerical values for each Example tissue regarding the following attributes: Fuzzy attribute for both sides of the tissue; Gritty attribute for both sides of the tissue; Grainy attribute for both sides of the tissue; stiffness; and thickness. For each Example bath tissue, the tissue samples were dispensed from the rolls to 13.5 by 4.5 inches (3 sheet strips; 10 strips per stack).

The Fuzzy attribute was ranked on a scale from 0 described as none/bald to 7 described as much/fuzzy. The panelists were asked to consider the amount of fibers, pile, fiber, nap, and fuzz on the tissue surface. The panelists were instructed to place a single tissue sample flat on a smooth tabletop with the side to be tested facing up and, using the pads of the index and middle fingers, move the single tissue sample in quarter-sized circular motions very lightly across several areas of the sample.

The Gritty attribute was ranked on a scale from 0, described as smooth, to 7 described as gritty. The panelists were asked to consider the amount of sharp, prickly, abrasive particles or fibers felt on the surface of the sample. The panelists were instructed to place a single tissue sample on a table with the side to be tested facing up, with forearm/elbow resting on the table, and using the full length of the fingers, slowly glide the fingers lightly across the entire surface one inch from the edge moving left to right, use the other hand to rotate the tissue sample and stroke along all four directions, and evaluate the grittiest direction.

The Grainy attribute was ranked on a scale from 0 described as smooth to 7 described as grainy. The panelists were asked to consider the pebbly texture of the tissue sample (feeling of grains of sand, rice), and to evaluate by considering the frequency, size, and hardness/firmness/rigidity of grains. It was noted that the panelist's perception can include shape, orientation, and size of texture (pattern/embossing), small rounded particles, and fibers. The panelists were instructed to: place a single tissue sample on a table with the side to be tested facing up, with forearm/elbow resting on the table and using the pads of the index and middle fingers, slowly and gently move the pads of the fingers across the surface going slightly into the surface of the sample, one inch from the edge moving left to right, use the other hand to rotate the tissue sample and stroke along all four directions, and evaluate the grainiest direction.

Stiffness was ranked on a scale from 0, described as pliable/flexible, to 7 described as stiff/rigid. The panelists were asked to consider the amount of pointed, rippled, or cracked edges or peaks felt from the sample while turning in the hand. The panelists were instructed to place two (2) tissue samples flat on a smooth tabletop; the bath tissue samples should overlap one another by 0.5 inch and be flipped so that opposite sides of the tissue samples are represented during testing; with forearm/elbow resting on the table, place the open hand palm down on the samples; position the hand so the fingers are pointing toward the top of the samples approximately 1.5 inch from the edge; draw the fingers toward the palm with little or no downward pressure to gather the tissue samples; and gently move the gathered samples around in the palm of the hand approximately 2–3 turns.

Thickness was ranked on a scale from 0 described as thin to 7 described as thick. The panelists were asked to consider the relative depth of tissue (perceived distance between thumb and one/two fingers). The panelists were instructed to use a single sample piece, gently hold the tissue with thumb between the index and second fingers; with the other hand gently pull the tissue out of the hold; repeat this procedure several times on the lower edge of the tissue to evaluate the degree of thickness as the fingers come together off the edge of the tissue.

For purposes herein, the term "paper" is used broadly to include writing, printing, wrapping, sanitary, and industrial papers, newsprint, liner board, tissue, napkins, wipers, towels, or the like. Further, "tissue web" or "tissue sheet" is used to refer to a cellulosic web suitable for making or use as a facial tissue, bath tissue, paper towels, napkins, or the like. Tissue web can be layered or unlayered, creped or uncreped, and can consist of a single ply or multiple plies. In addition, the tissue web can contain reinforcing fibers for integrity and strength. Tissue webs suitable for use in accordance with this invention are characterized by being absorbent, of low density and relatively fragile, particularly in terms of wet strength. Densities are in the range of from about 0.1 to about 0.3 grams per cubic centimeter. Absorbency is about 5 grams of water per gram of fiber, and from about 5 to about 9 grams of water per gram of fiber. Wet tensile strengths are about 0 to about 300 grams per inch of width and typically are at the low end of this range, such as from about 0 to about 30 grams per inch. Dry tensile strengths in the machine direction are from about 100 to about 2000 grams per inch of width, preferably from about 200 to about 350 grams per inch of width. Tensile strengths in the cross-machine direction are from about 50 to about 1000 grams per inch of width, preferably from about 100 to about 250 grams per inch of width. Dry basis weights are in the range of from about 5 to about 60 pounds per 2880 square feet.

Many fiber types are used for the present invention, including hardwood or softwoods, straw, flax, milkweed seed floss fibers, abaca, hemp, kenaf, bagasse, cotton, reed, and the like. All known papermaking fibers may be used, including bleached and unbleached fibers, fibers of natural origin (including wood fiber and other cellulosic fibers, cellulose derivatives, and chemically stiffened or cross linked fibers) or synthetic fibers (synthetic papermaking fibers include certain forms of fibers made from polypropylene, acrylic, aramids, acetates, and the like), virgin and recovered or recycled fibers, hardwood and softwood, and fibers that have been mechanically pulped (e.g., groundwood), chemically pulped (including but not limited to the kraft and sulfite pulping processes), thermomechanically pulped, chemithermomechanically pulped, and the like. Mixtures of any subset of the above mentioned or related fiber classes may be used. The fibers are prepared in a multiplicity of ways. Useful methods of preparing fibers include dispersion to impart curl and improved drying properties.

Once formed, the paper web is processed using a wide variety of papermaking operations. For example, the paper web may be wet pressed, throughdried, creped, uncreped, or processed using a variety of other procedures known in the art.

Numerous features and advantages of the present invention will appear from the following description and reference made to the accompanying drawing which illustrates preferred embodiments of the invention. Such embodiments do not represent the full scope of the invention. Reference should be made therefore to the claims herein for interpreting the full scope of the invention.

The invention will now be described in detail with reference to the Figures, where similar elements in different Figures have been given the same reference numeral. A paper product such as bathroom tissue 10 is texturized using the process depicted in FIG. 1. The tissue 10 is unwound from a roll 22 of tissue and fed into an embossing nip 24 formed between an engraved steel embossing roll 30 and a backing roll 32. The resulting texturized tissue 20 is wound into bathroom tissue roll logs at a winder 36. The logs subsequently are cut into appropriate widths and the resulting individual tissue rolls are packaged (not shown). While the invention is described in specific relation to bathroom tissue, the invention may be useful with a wide variety of paper products.

Figure 2:
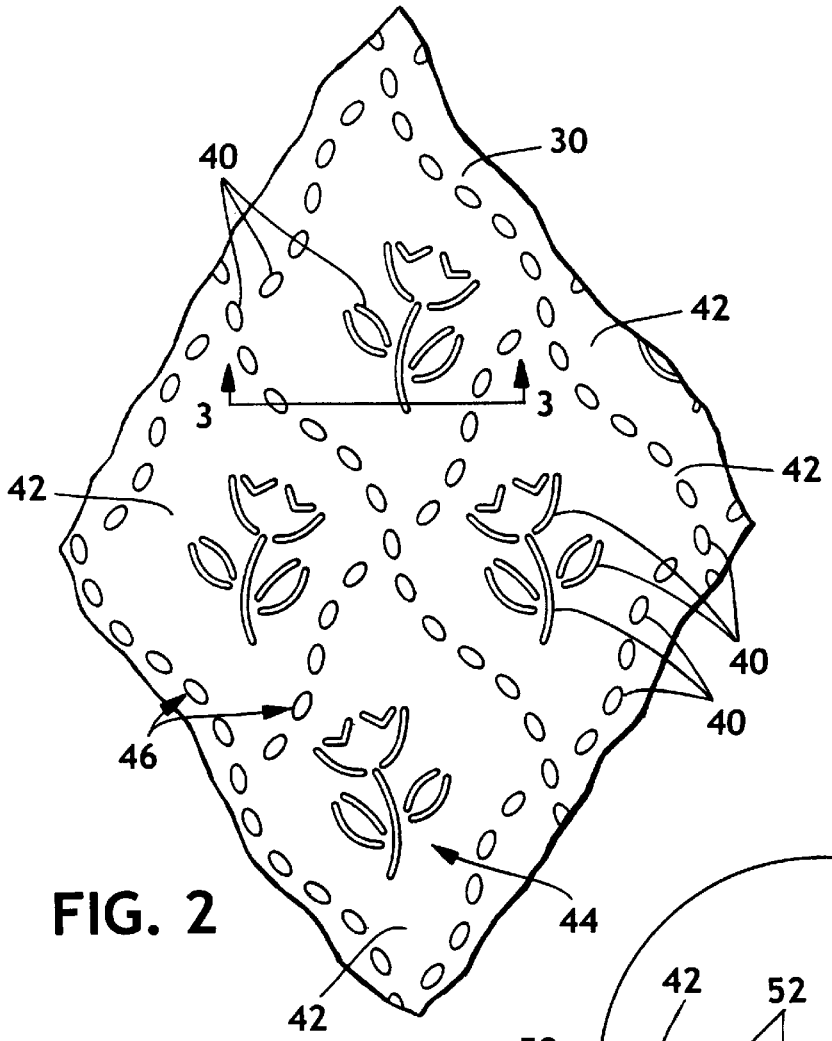
FIG. 2 is a perspective plan view of a portion of an engraved embossing roll used in the process shown in FIG. 1.

A plan view of a portion of the surface of an exemplary embossing roll 30, which is also referred to as a pattern roll, is shown in FIG. 2. The surface of the embossing roll 30 includes a plurality of discrete male embossing elements 40 are separated by relatively smooth land areas 42. The male embossing elements 40 are raised above the surface of the land areas 42 and are pressed into the tissue 20 to form a corresponding image of the embossing pattern when the tissue is processed through the embossing nip 24.

Figure 3:
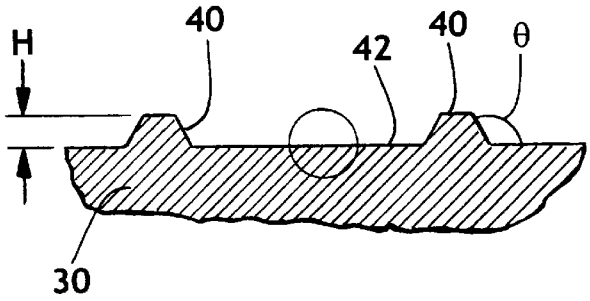
FIG. 3 is an enlarged section view taken along the plane of line 3—3 in FIG. 2.

The embossing roll 30 is shown in section view in FIG. 3 to show various dimensions of a male embossing element 40. The male embossing elements 40 protrude from the land areas 42 by a distance or height H, of about 0.005 inch (0.13 mm) or greater, e.g., such as from about 0.005 to about 0.07 inch (0.13–1.78 mm), and preferably from about 0.028 to about 0.04 inch (0.71–1.02 mm). The width of the male embossing elements at the tip is typically from about 0.005 to about 0.50 inch (0.127–12.7 mm). The sidewall angle, theta (θ), as measured relative to the plane tangent to the surface of the roll at the base of the embossing element, is from about 90 degrees to about 130 degrees. The embossing roll 30 is formed by engraving or other techniques described herein above.

Including in the illustrated embossing design, the male embossing elements 40 define a decorative pattern including a plurality of flowers 44 separated by intersecting sets of dotted lines 46. Each flower 44 depicted in FIG. 2 includes a pattern of nine individual embossing elements. Pattern groupings can depict flowers, leaves, birds, animals, waves, or any artistic concept.

Figure 4:
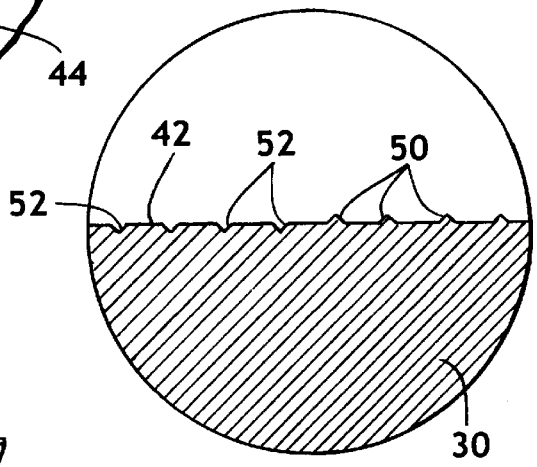
FIG. 4 is an enlarged side elevation view of the encircled area shown in FIG. 3.

FIG. 4 shows an enlarged view of a land area 42 from the encircled area in FIG. 3, including in one embodiment of the present invention. The land areas 42 of the embossing roll 30 preferably include a plurality of fine ridges 50 extending radially around the roll, or a plurality of fine channels 52 depressed into the steel roll and extending radially around the roll. The roll could include only ridges 50, only channels 52, or any combination of the two. The ridges or channels contribute to working of the surface fibers.

The ridges 50 have a height dimension and the channels 52 have a depth dimension measured from the surrounding surface of the land area 42 of about 0.1 millimeter (0.004 inch) or less, preferably about 0.08 millimeter (0.003 inch) or less, e.g., such as about 0.05 millimeter (0.002 inch) or less. The width dimension of the ridges or channels or both, measured parallel to the axis of the roll, is about 0.08 millimeter (0.003 inch) or less, preferably about 0.05 millimeter (0.002 inch) or less, e.g., such as about 0.025 millimeter (0.001 inch). The ridges or channels or both preferably are spaced apart from one another by about 0.08 to about 0.18 millimeter (0.003–0.007 inch).

Figure 5:
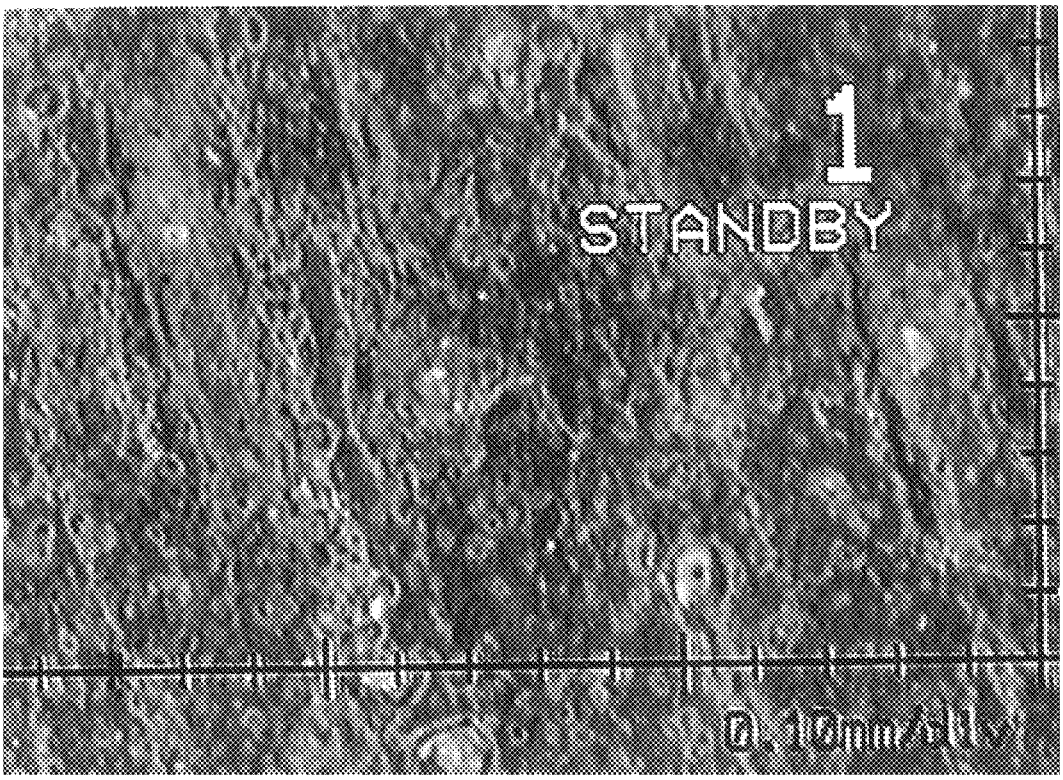
FIG. 5 shows a photomicrograph image of a plan view of a laser engraved embossing roll according to the present invention.
Figure 6:
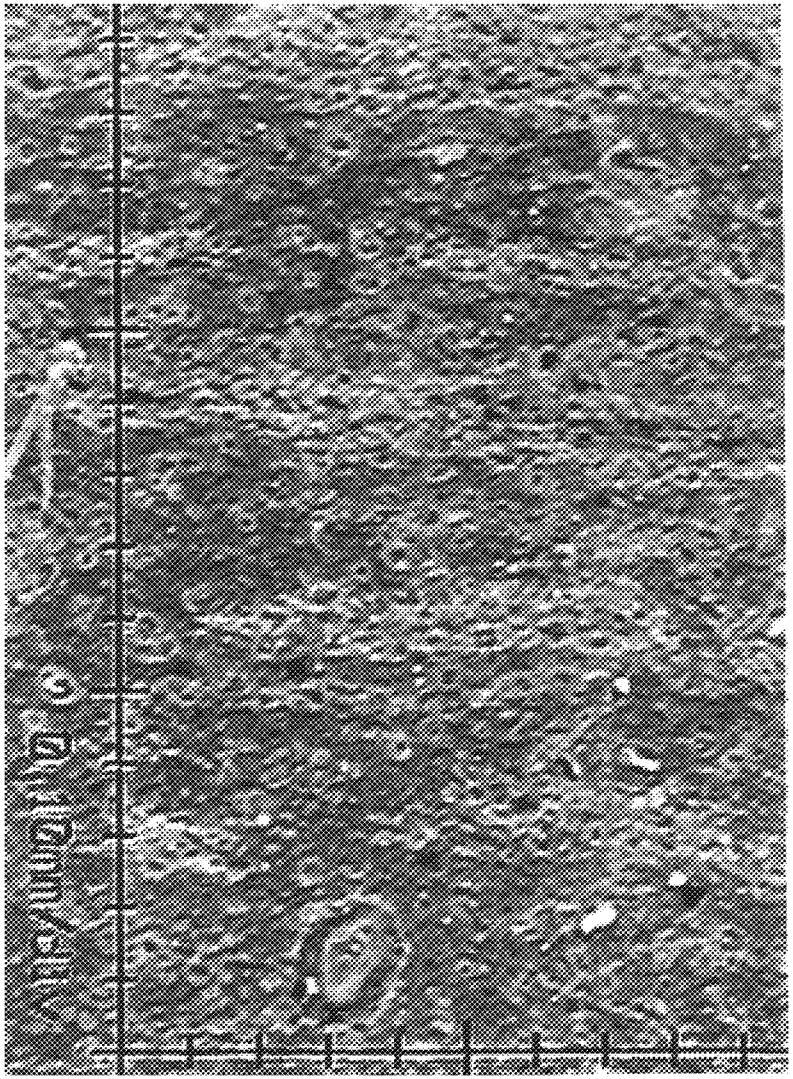
FIG. 6 shows a photomicrograph image in a plan view of the laser engraved embossing roll of FIG. 5.
Figure 7:
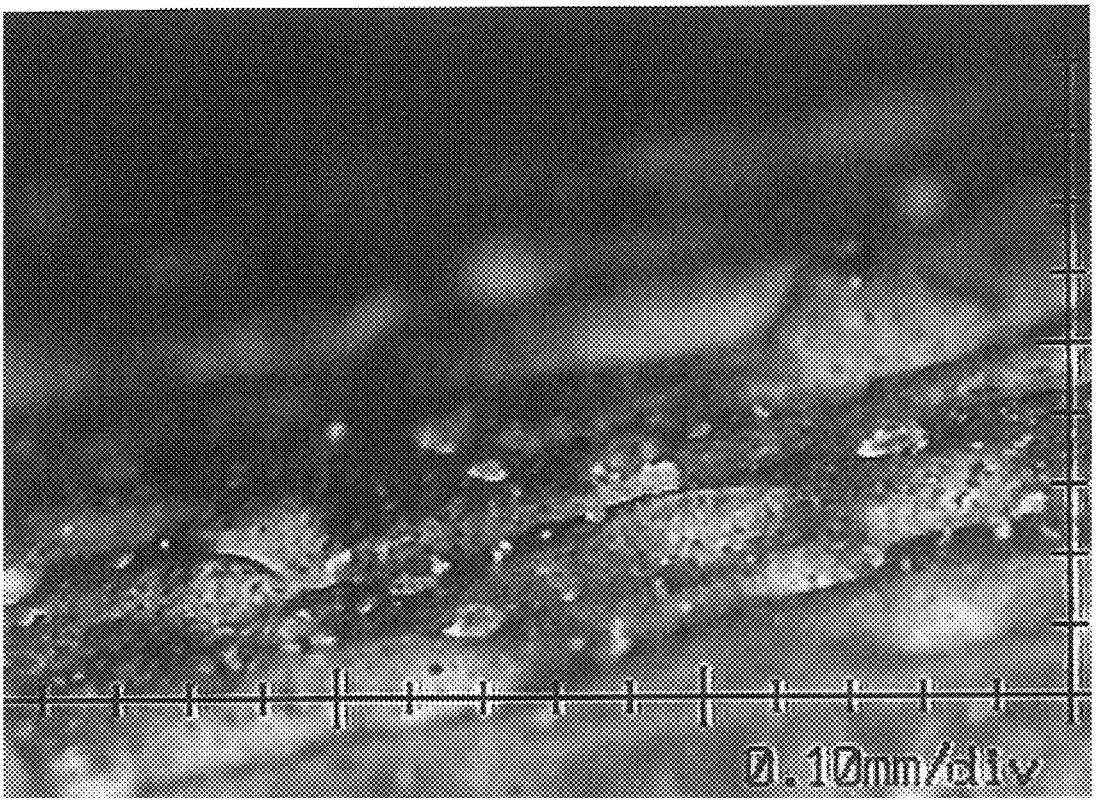
FIG. 7 shows a photomicrograph image of an elevation view of the laser engraved embossing roll of FIG. 5.

FIGS. 5–8 show photomicrograph images of a laser engraved embossing roll according to the present invention. The photomicrographs of FIGS. 5–7 illustrate the roughened surface of the land areas 42. The land areas include protuberances and pitted surface features that work, flex, or displace the surface fibers of the tissue 20 as the tissue 20 is processed through the embossing nip 24.

Figure 8:
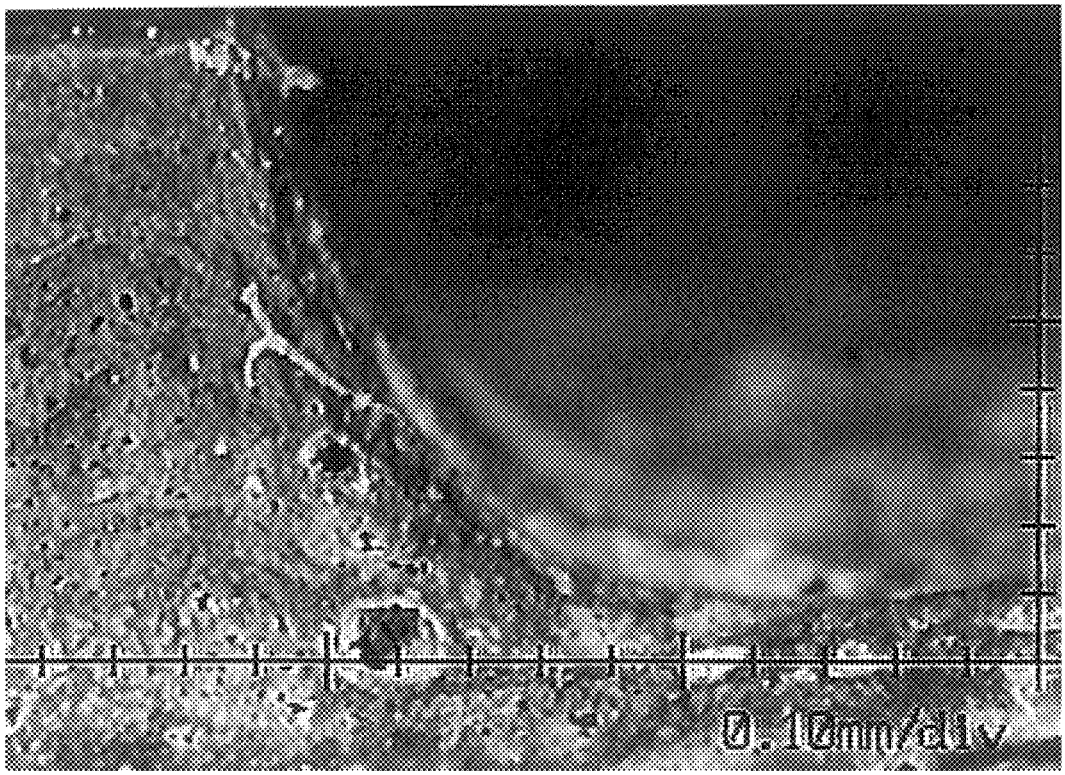
FIG. 8 shows a photomicrograph image of an elevation of the laser engraved embossing roll of FIG. 5 at the interface between a male embossing element and a land area.

The photomicrograph of FIG. 8 shows the same roll as FIGS. 5–8 but at an interface between a male embossing element 40 and a land area 42. Because the roughened surface of this particular roll was formed by laser engraving, the roughened surface encompasses the sides of the male embossing elements as well as the land areas.

Figure 9:
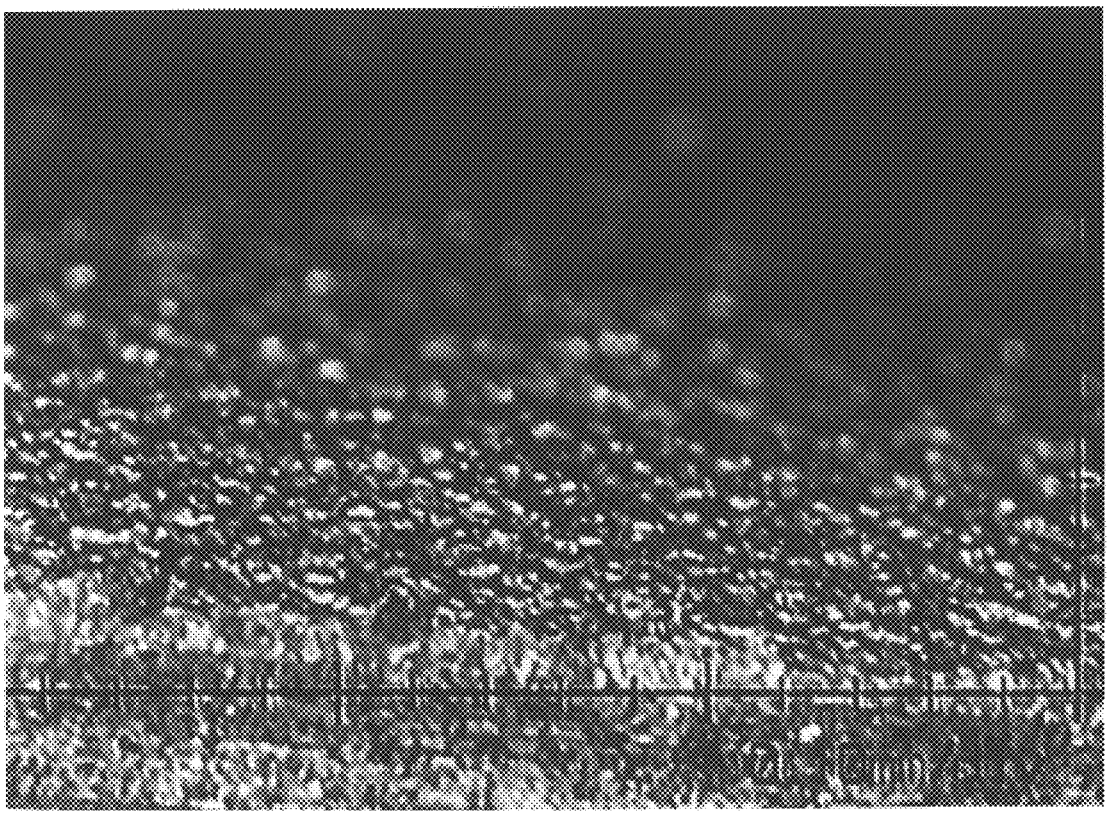
FIG. 9 shows a photomicrograph image of an elevation of a conventional steel embossing roll.
Figure 10:
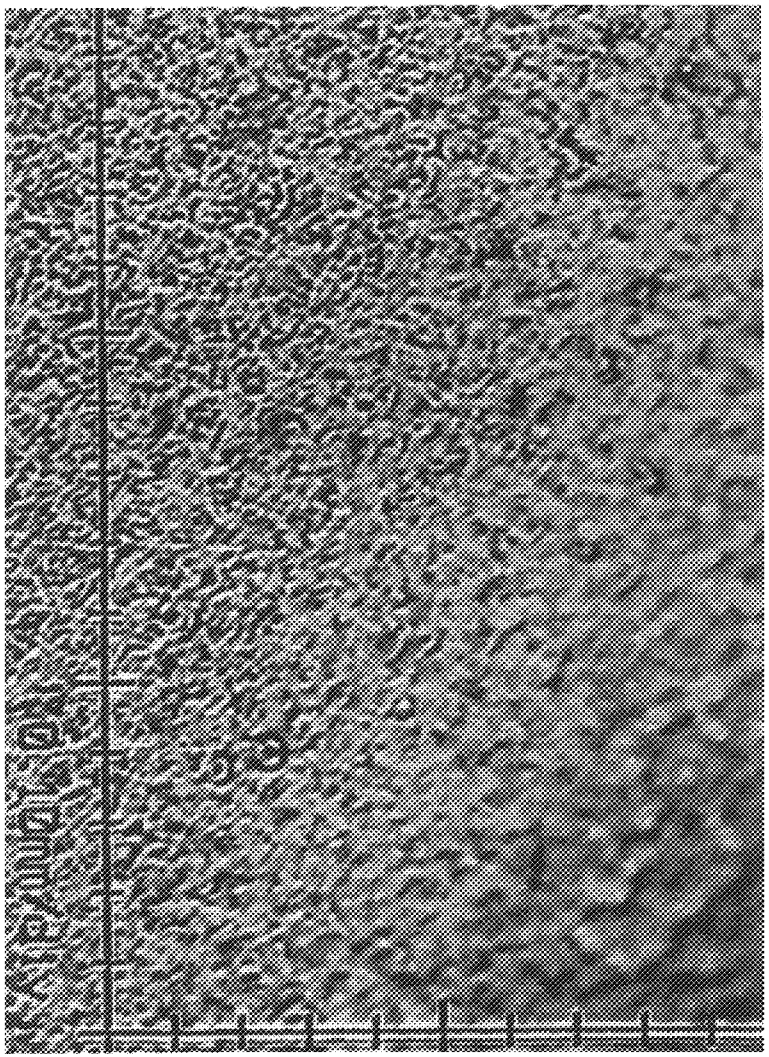
FIG. 10 shows a photomicrograph image at a 45 degree top view of the conventional steel embossing roll of FIG. 9.

For purposes of comparison, FIGS. 9 and 10 show photomicrograph images of a conventional steel embossing roll. Conventional steel embossing rolls have a surface finish with imperfections on the order of 0.005 mm or smaller in height and about 0.001 mm in width, which take the form of random ridges in a more-or-less honey-comb pattern as shown by the photo-micro-graphs.

The backing roll 32 includes a smooth rubber covered roll, an engraved roll such as a steel roll matched to the pattern roll or the like. The bonding nip is set to a pattern/backing roll loading pressure from about 30 to about 300 pounds per lineal inch (phi), and more preferably about 50 to about 150 phi, e.g., such that the embossing pattern is imparted to the tissue web 10. The backing roll is a material that meets the process requirements such as natural rubber, synthetic rubber, or other compressible surfaces, and has a Shore A surface hardness of about 20 Durometer or greater, preferably 40 Durometer or greater, e.g., such as about 75 Durometer. Preferably, the backing roll includes a resilient, conformable material.

EXAMPLES

The following Examples are provided to give a more detailed understanding of the invention. The particular amounts, proportions, compositions, and parameters are meant to be exemplary, and are not intended to limit specifically the scope of the invention.

These Examples were the result of a large, designed experiment using one of three base sheets, designated Paper Codes A, B and C. The base sheets had differing basis weights but otherwise had essentially similar properties. Each base sheet was composed of sulfite pulp containing one-third northern softwood and two-thirds northern hardwood. Paper Code A was 16.5 lb. per 2880 $ft^2$ bone dry; Paper Code B was 15.9 lb. per 2880 $ft^2$ bone dry; and Paper Code C was at 15.2 lb. per 2880 $ft^2$ bone dry. The 10 sheet caliper ranged from 0.072 to 0.077 inch (1.829 to 1.956 mm.), and the Geometric Mean Tensile (GMT) strength ranged from 650 to 800 per g/3" strip. The base sheets were slit into narrow rolls for converting.

In each Example, the base sheet was processed through a pilot scale converting line operating at 1000 feet per minute. Like single-ply base sheets were unwound from two belt driven unwind stands. The two plies were plied together using an S-wrap marrying roll and a crimping unit. The two-ply web then was embossed using a small roll rubber-to-steel embossing device, but replacing the steel roll with laser engraved ebonite in pilot scale trials. The embossing roll included a textured or roughened surface between the embossing elements as shown in FIGS. 2–4. The basesheet then was rewound into logs and cut into individual rolls of bath tissue using a log saw.

The embossing roll used in the Examples was an ebonite roll having the embossing pattern shown in FIG. 2. In addition, the ebonite roll was laser engraved at 500 dots per inch (dpi) which left a roughened surface finish. The engraving process resulted in the land areas of the roll having multiple imperfections on the order of 0.1 mm in all three axes, with some imperfections being larger and some being smaller in a random occurrence (see photomicrographs of FIGS. 5–8). In combination with these imperfections, the land areas of the laser engraved rolls also included some channels of the type illustrated in FIG. 4.

The resilient backing rolls used in the Examples were formed of a compounded rubber material known by the trade name HYPALON. The resilient backing rolls used were either 63 or 75 shore A Durometer.

Example 1

Bath tissue rolls designated Roll Code 6 were formed from the heaviest weight tissue, Paper Code A, using the converting process described herein above. The embossing roll included a 0.040 inch deep embossing pattern, and the resilient backing roll had an exterior covering with a Shore A hardness of 75 Durometer. The embossing nip was set to 103 pounds per lineal inch (pli). The resulting roll diameter was 4.6 inches.

Example 1 represented embossing conditions for element height, backing roll hardness and nip pressures used for 2-ply bath tissue. The tensile strength of the tissue was 671.4 grams per 3 inches. Tissue samples from Example 1 were prepared for sensory evaluation and resulted in a SPP Fuzzy-up value of 5.08.

Example 1B

Example 1B was similar to Example 1 except that Paper Code B was used. The tensile strength of the tissue was 598.3 grams per 3 inches, and the SPP Fuzzy-up value was 4.92.

Example 1C

Example 1C was similar to Example 1 except that Paper Code C was used. The tensile strength of the tissue was 543.3 grams per 3 inches, and the SPP Fuzzy-up value was 5.23.

Example 2

Bath tissue rolls designated Roll Code 21 were formed from Paper Code A using the converting process described above. The embossing roll included a 0.034 inch deep embossing pattern, and the resilient backing roll had an exterior covering with a Shore A hardness of 75 Durometer. The embossing nip was set to 117 pli. The resulting roll diameter was 4.6 inches.

Example 2 employed slightly greater nip pressure and a shallower embossing pattern depth which places the tissue sheet closer to the roughened area between the male embossing elements. The tensile strength of the tissue was 612.2 grams per 3 inches. Tissue samples from Example 2 were prepared for sensory evaluation and resulted in a SPP Fuzzy-up value of 5.09.

Example 2B

Example 2B was similar to Example 2 except that Paper Code B was used and the nip pressure was 135 pli. The tensile strength of the tissue was 540.5 grams per 3 inches, and the SPP Fuzzy-up value was 5.05.

Example 2C

Example 2C was similar to Example 2 except that Paper Code C was used. The tensile strength of the tissue was 603.5 grams per 3 inches and the SPP Fuzzy-up value was 5.07.

Example 3

Bath tissue rolls designated Roll Code 16 were formed from Paper Code A using the converting process described above. The embossing roll included a 0.034 inch deep embossing pattern and the resilient backing roll had an exterior covering with a Shore A hardness of 75 Durometer. The embossing nip was set to 129 phi. The resulting roll diameter was 4.9 inches.

Example 3 used increased embossing pressure to force the tissue sheet to deform far enough to benefit significantly from the roughened area between the male embossing elements. The tensile strength of the tissue was 605.0 grams per 3 inches. Tissue samples from Example 3 were prepared for sensory evaluation and resulted in a SPP Fuzzy-up value of 5.35.

Example 3B

Example 3B was similar to Example 3 except that Paper Code B was used and the nip pressure was 135 pli. The tensile strength of the tissue was 605.3 grams per 3 inches, and the SPP Fuzzy-up value was 5.11.

Example 4

Bath tissue rolls designated Roll Code 22 were formed from Paper Code A using the converting process described above. The embossing roll included a 0.028 inch deep embossing pattern, and the resilient backing roll had an exterior covering with a Shore A hardness of 63 Durometer. The embossing nip was set to 94 phi. The resulting roll diameter was 4.6 inches.

Example 4 represents a preferred embodiment of the present invention in that the softer backing roll forces the tissue sheet to deform far enough to benefit significantly from the roughened area between the male embossing elements even though it was run with a reduced embossing pressure. The tensile strength of the tissue was 620.7 grams per 3 inches. Tissue samples from Example 4 were prepared for sensory evaluation and resulted in a SPP Fuzzy-up value of 5.43.

Example 4B

Example 4B was similar to Example 4 except that Paper Code B was used and the nip pressure was 64 phi. The tensile strength of the tissue was 560.3 grams per 3 inches, and the SPP Fuzzy-up value was 5.48.

Example 4C

Example 4C was similar to Example 4B except that Paper Code C was used. The tensile strength of the tissue was 571.6 grams per 3 inches, and the SPP Fuzzy-up value was 5.38.

Example 5

Bath tissue rolls designated Roll Code 27 were formed from Paper Code A using the converting process described above. The embossing roll included a 0.028 inch deep embossing pattern, and the resilient backing roll had an exterior covering with a Shore A hardness of 63 Durometer. The embossing nip was set to 96 pli. The resulting roll diameter was 4.9 inches.

Example 5 represents another preferred embodiment of the present invention similar to Example 4 although the sheet is not wound under as much tension as the 4.6" diameter rolls. The tensile strength of the tissue was 632.1 grams per 3 inches. Tissue samples from Example 5 were prepared for sensory evaluation and resulted in a SPP Fuzzy-up value of 5.54.

Example 5B

Example 5B was similar to Example 5 except that Paper Code B was used, and the nip pressure was 71 phi. The tensile strength of the tissue was 538.8 grams per 3 inches, and the SPP Fuzzy-up value was 5.41.

Example 6

Example 6 was similar to Example 1 except that the nip pressure was 98 phi, and the roll diameter was 4.9 inches. The tensile strength of the tissue was 618.0 grams per 3 inches, and the SPP Fuzzy-up value was 5.22.

Example 6B

Example 6B was similar to Example 6 except that Paper Code B was used, and the nip pressure was 123 phi. The tensile strength of the tissue was 626.9 grams per 3 inches, and the SPP Fuzzy-up value was 4.95.

Table 1 below summarizes the data from the Examples. In the Table, "Roll Drm." refers to the resilient rubber backing roll Durometer measured in Shore A hardness, "Nip Prs."

refers to the embossing nip pressure, and "Roll Dia." refers to the diameter of the finished bathroom tissue roll.

TABLE 1

| Ex. # | Roll Code | Paper Code | Laser roll Depth (inch) | Roll Drm. | Nip Prs. (pli) | Roll Dia. (inch) | GMT Tensile Strength (g/3") | SPP Fuzzy (up) |
|---|---|---|---|---|---|---|---|---|
| 1 | 6 | A | 0.040 | 75 | 103 | 4.6 | 671.4 | 5.08 |
| 1B | 8 | B | 0.040 | 75 | 103 | 4.6 | 598.3 | 4.92 |
| 1C | 7 | C | 0.040 | 75 | 103 | 4.6 | 543.3 | 5.23 |
| 2 | 21 | A | 0.034 | 75 | 117 | 4.6 | 612.2 | 5.09 |
| 2B | 19 | B | 0.034 | 75 | 135 | 4.6 | 540.5 | 5.05 |
| 2C | 20 | C | 0.034 | 75 | 117 | 4.6 | 603.5 | 5.07 |
| 3 | 16 | A | 0.034 | 75 | 129 | 4.9 | 605.0 | 5.35 |
| 3B | 18 | B | 0.034 | 75 | 135 | 4.9 | 605.3 | 5.11 |
| 4 | 22 | A | 0.028 | 63 | 94 | 4.6 | 620.7 | 5.43 |
| 4B | 24 | B | 0.028 | 63 | 64 | 4.6 | 560.3 | 5.48 |
| 4C | 23 | C | 0.028 | 63 | 64 | 4.6 | 571.6 | 5.38 |
| 5 | 27 | A | 0.028 | 63 | 96 | 4.9 | 632.1 | 5.54 |
| 5B | 25 | B | 0.028 | 63 | 71 | 4.9 | 538.8 | 5.41 |
| 6 | 11 | A | 0.040 | 75 | 98 | 4.9 | 618.0 | 5.22 |
| 6B | 9 | B | 0.040 | 75 | 123 | 4.9 | 626.9 | 4.95 |

All SPP data in this study had scatter within the groupings because of other variables in the experimental design. Localized GMT variability for tissue manufacturing of up to 10% was considered acceptable. Relevant variables included differences in base-sheet, changing embossing nip loading, changing rubber roll Durometer, and changing the finished roll diameter from 4.6" to 4.9". The data progressions for Paper Codes B and C were found to be similar to that of Paper Code A.

Figure 11:
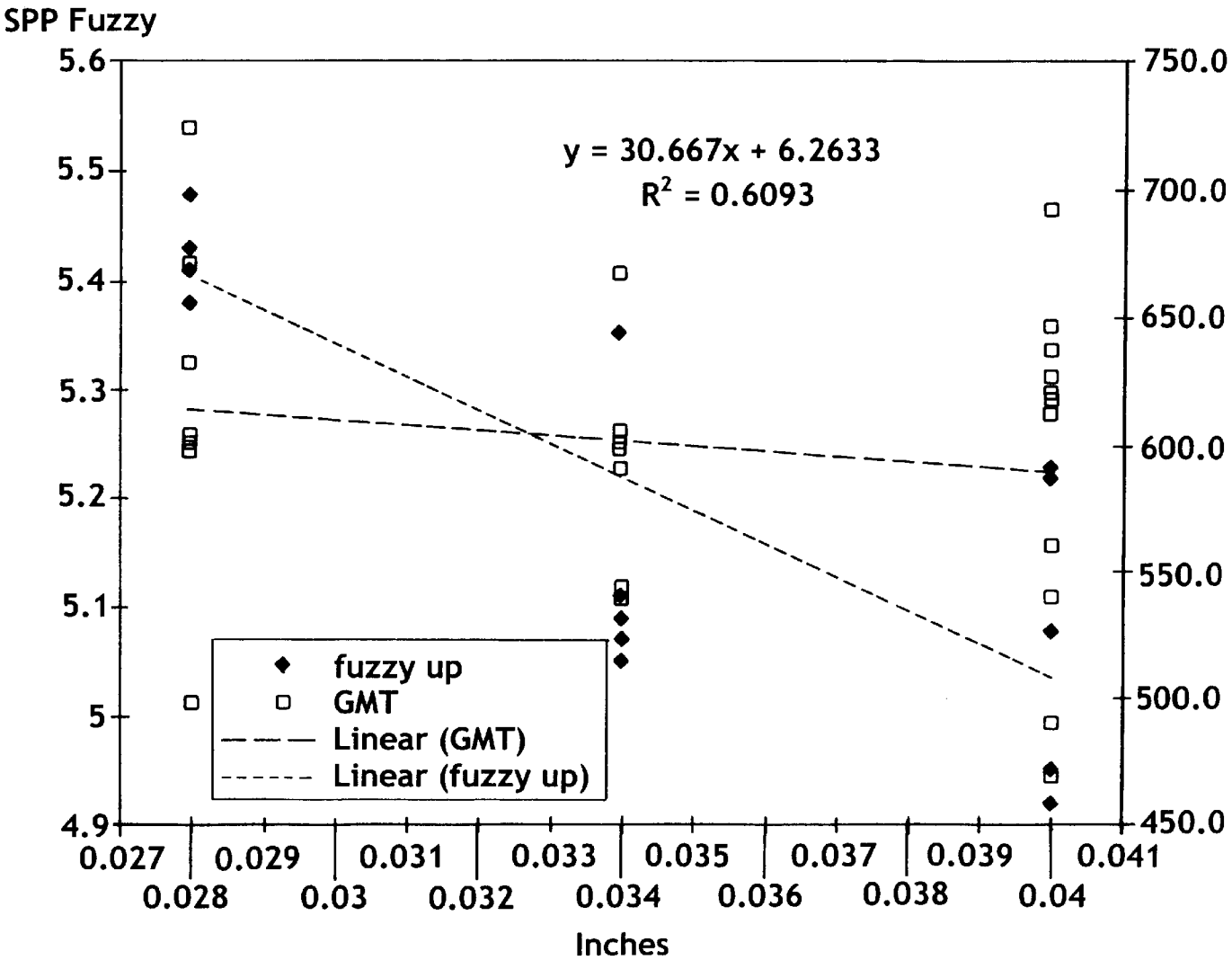
FIG. 11 shows a graphical depiction of SPP Fuzzy (up) and tensile strength values versus male embossing element height for the Examples.

With reference to FIG. 11, the SPP Fuzzy up rating showed a reasonable correlation to the embossing pattern depth, but this effect was not tied to a commensurate decrease in the GMT as normally would have been expected according to a strength-soft-ness relationship. This result was attributable to the sheet contacting the rough finish of the laser sleeve in between the male embossing elements and breaking some of the inter-fiber hydrogen bonds, thereby freeing a fiber end to project out toward the user. Even though there were no marks visible to the naked eye, when examining the background areas of the embossed sheet, the SPP data indicated the beneficial effect of this texturizing action, and an analytical "fuzz-on-edge" technique showed that Example 4 was 1.33 times as fuzzy as Example 1.

Figure 12:
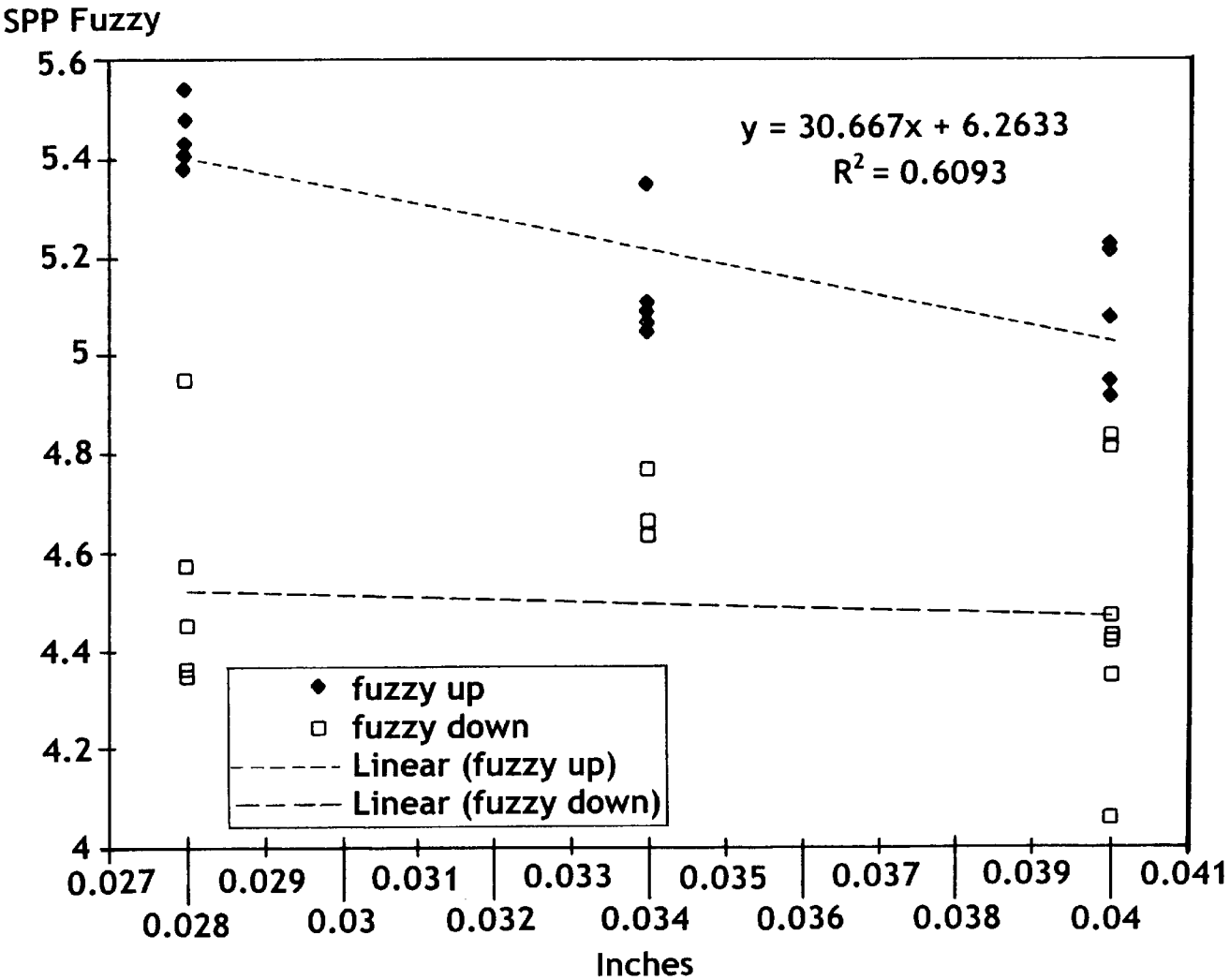
FIG. 12 shows a graphical depiction of SPP Fuzzy (up and down) values versus male embossing element height for the Examples.

These results were supported by the SPP Fuzzy down rating which is done on the side of the sheet that does not contact the pattern embossing roll. With additional reference to FIG. 12, the Fuzzy down ratings on these codes did not exhibit the increase in rating with decrease in element height that was apparent with the Fuzzy up ratings. The 'up' side of the tissue was in contact with the laser engraved embossing roll. The roughened laser roll surface worked some fibers loose on the surface of the sheet, thereby increasing the Fuzzy up rating.

Figure 13:
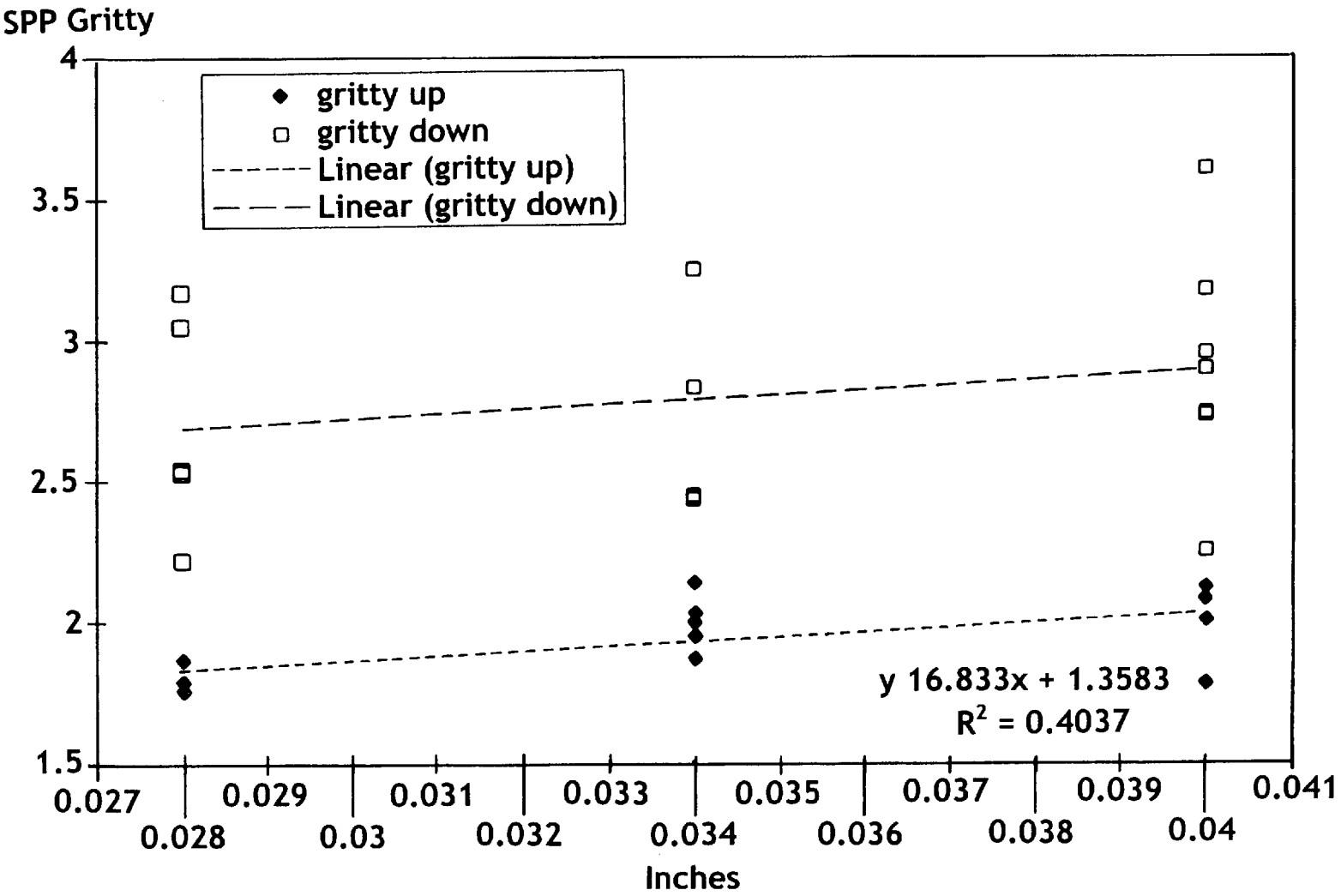
FIG. 13 shows a graphical depiction of SPP Gritty (up and down) values versus male embossing element height for the Examples.

The SPP Gritty up and down ratings also showed a beneficial impact as the embossing element height was reduced, as shown by reference to FIG. 13. This impact is attributable to an increased calendaring effect as the element height was reduced, since the drop in the Gritty up rating trend line was paralleled by a drop in the Gritty down rating trend line. Such a parallel result between the sides of a two-ply tissue sheet applied for both Gritty and Fuzzy, and highlighted the present invention disclosed herein when the Fuzzy lines did not exhibit the expected trend.

While the selection of an embossing element height for use in a particular application is dependent on a number of equipment and product form constraints, the Examples show that a beneficial effect is achieved when using the roughened embossing roll surface of the present invention, particularly when combined with selecting a lower male embossing element height.

While the actual examples concentrated on rubber to steel embossing, a similar result is produced to an extent in a properly prepared set of matched steel or paper on steel embossing rolls. Production of such effect is dependent on the penetration (distance off bottom) at which the embossing rolls are run.

The results obtained from the 63 Durometer rubber roll better embodied the desired inventive step, but the 75 Durometer roll results showed a similar although lower response in the same direction. The use of alternative roll compositions or alternative Durometer rubber rolls (either higher, or lower) will achieve the exact level of texturizing that is desired.

The foregoing detailed description has been for the purpose of illustration. Thus, a number of modifications and changes may be made without departing from the spirit and scope of the present invention. For instance, alternative or optional features described as part of one embodiment are used to yield another embodiment. Additionally, two named components could represent portions of the same structure. Further, various alternative process and equipment arrangements may be employed. Therefore, the invention should not be limited by the specific embodiments described, but only by the claims and all equivalents thereto.

I claim:

1. A method of making a paper product, comprising:

providing a paper product having a paper surface and a paper surface region treated by contact with a roughened embossing roll to form a minority of fiber to fiber bonds broken in said paper surface region to a depth less than about 0.02 mm from said paper surface, said paper product having a majority of bonds maintained substantially not broken in an interior region at a depth from said paper surface of more than about 0.02 mm.

2. A method of making a paper product as set forth in claim 1, wherein said roughened embossing roll comprises protuberances or depressions sized at less than about 0.1 mm.

3. A method of making a paper product as set forth in claim 1, wherein said roughened embossing roll comprises protuberances or depressions adapted to produce paper product surface deformations in said paper surface, wherein said paper product surface deformations are invisible to an unaided human eye.

4. A method of making a paper product as set forth in claim 1, wherein said paper product further comprises decorative embossing.

5. A method of making a paper product as set forth in claim 1, wherein said roughened embossing roll comprises pits having a depth less than about 0.1 mm.

6. A method of making a paper product as set forth in claim 1, wherein said step of providing a paper product having a paper surface and a paper surface region treated by contact with a roughened embossing roll to form a minority of fiber to fiber bonds broken in said paper surface region to a depth less than about 0.02 mm from said paper surface forms a paper product having higher perceived softness.

7. A method of making a paper product as set forth in claim 1, wherein said roughened embossing roll comprises channels having a depth of less than about 0.1 mm.

8. A paper product, comprising:

a paper tissue web having a paper surface and a paper surface region treated by contact with a roughened embossing roll to form a minority of fiber to fiber bonds broken in said paper surface region to a depth less than about 0.02 mm, said paper tissue web having fiber to fiber bonds maintained substantially not broken in an interior region at a depth from said paper surface of more than about 0.02 mm.

9. A paper product as set forth in claim 8, wherein said roughened embossing roll comprises protuberances or depressions sized at less than about 0.1 mm.

10. A paper product as set forth in claim 8, wherein said paper product comprises paper product surface deformations are invisible to the unaided human eye formed by said roughened embossing roll protuberances or depressions.

11. A paper product as set forth in claim 8, wherein said paper product further comprises decorative embossing.

12. A paper product as set forth in claim 10, wherein said roughened embossing roll comprises etched protuberances or depressions having a height or depth less than about 0.1 mm.

13. A paper product as set forth in claim 8, wherein said paper tissue web having a paper surface region treated by contact with said roughened embossing roll exhibits softness while maintaining substantially similar levels of tensile strength.

14. A paper product as set forth in claim 8, wherein said roughened embossing roll comprises channels having a depth of less than about 0.1 mm.

* * * * *